United States Patent [19]

Wilson

[11] Patent Number: 4,706,876

[45] Date of Patent: Nov. 17, 1987

[54] SLEEVE-TYPE CARRIER HANDLE

[75] Inventor: Jerry F. Wilson, West Monroe, La.

[73] Assignee: Manville Corporation, Denver, Colo.

[21] Appl. No.: 908,547

[22] Filed: Sep. 18, 1986

[51] Int. Cl.[4] ..... B65D 5/46

[52] U.S. Cl. ..... 229/52 B; 206/427; 229/40

[58] Field of Search ..... 229/40, 52 B, 52 BC; 206/427, 434, 141

[56] References Cited

U.S. PATENT DOCUMENTS

| | | | |
|---|---|---|---|
| 2,785,847 | 3/1957 | Forrer | 206/427 |
| 4,240,546 | 12/1980 | Stone | 229/52 B |
| 4,382,510 | 5/1983 | Gaffney | 229/52 B |
| 4,588,084 | 5/1986 | Holley, Jr. | 229/52 B |
| 4,653,686 | 3/1987 | Wood et al. | 229/52 B |

FOREIGN PATENT DOCUMENTS

| | | | |
|---|---|---|---|
| 712905 | 7/1965 | Canada | 229/52 B |

*Primary Examiner*—Stephen Marcus
*Assistant Examiner*—Gary E. Elkins
*Attorney, Agent, or Firm*—John D. Lister; Cornelius P. Quinn; Timothy R. Schulte

[57] ABSTRACT

A sleeve-type beverage can carrier having a transversely arranged handle opening in the top panel. The opening is covered by flaps foldably connected to the top panel along the transversely extending elongated edges of the handle opening, each flap being formed of individual tabs which facilitate the folding down of the flap by the fingers of a user. The elongated edges are tapered so that they are the most widely spaced apart midway along their length and the closest together near their ends. This arrangement causes the top panel on both sides of the handle opening to bow upwardly when the carrier is lifted to distribute the lifting stresses through the top panel and the upper portions of the side panels.

10 Claims, 6 Drawing Figures

SLEEVE-TYPE CARRIER HANDLE

FIELD OF THE INVENTION

This invention relates to a sleeve-type article carrier, and more particularly to a sleeve-type article carrier having an improved handle arrangement.

BACKGROUND OF THE INVENTION

One type of carrier commonly used to package beverage cans is formed from a generally rectangular paperboard blank which is folded and glued by the blank manufacturer into a sleeve-like configuration. The blanks are then shipped to bottling plants in generally flat collapsed condition where they are opened into sleeve form, loaded through their open ends with cans, and closed by folding and sealing the end flaps in place. The resulting package completely encloses the cans and can be lifted by a handle portion provided in the top panel.

A well known style of handle for this type of carrier comprises two hand openings in the top panel extending along the length of the package. The openings are located in the central part of the package and are spaced from each other to form a strap or handle portion between them. This arrangement has certain disadvantage. The high concentration of stresses at the handle openings requires the use of relatively heavy paperboard to combat tearing, which increases the cost of the package. Further, such a handle, often referred to as a suitcase type of handle, requires the thumb and fingers of the hand to hold the carrier in a manner that becomes tiring and tends to cut into the hand.

To overcome these problems a single handle opening extending transversely of the folds connecting the side panels of the carrier to the top panel has been proposed. The handle opening would thus be at right angles to the direction in which the openings of the suitcase type of handle extend. To carry the package, a user merely has to insert his fingers into the opening and lift it.

Even with a handle arrangement of this type, however, unless the design incorporates features for relieving the lifting stresses the paperboard will still have to be relatively thick and expensive. An example of a design which attempts to solve this problem is described in U.S. Pat. No. 4,558,816, issued to P. J. Wood. In this arrangement a transverse slit extends down into the upper regions of the side panels and connects with fold lines to aid in the distribution of lifting stresses. The stresses still tend to be concentrated more than desired, however, adjacent the ends of the transverse slit, creating the need to follow relatively rigid design parameters and causing the top panel to be pulled up by the lifting process higher and more abruptly than desired.

It would be desirable to provide a carrier having a transverse handle design which would enable a reduction in the caliper of the paperboard without introducing an undesirable degree of flexibility in the carrier handle structure.

BRIEF SUMMARY OF THE INVENTION

This invention provides an improved handle design which overcomes the problems mentioned above. Slits extending from the ends of a transverse handle opening terminate at the folds connecting the side panels of the carrier to the top panel, and the elongated edges of the handle opening are spaced apart at a point midway along their length a distance greater than their spacing adjacent the ends of the opening. This arrangement distributes the lifting stresses quite uniformly throughout the top panel, the side panels and the folds connecting the top panel to the side panels, causing the top panel of the carrier to bow upwardly adjacent both elongated edges of the handle opening.

These design features can readily be implemented in the standard type of production blank from which sleeve-type carriers are produced, requiring only minor modifications to the blank forming die to provide for new slit and score lines.

Other features and aspects of the invention will be made clear, as well as the various benefits of the invention, in the more detailed description of the invention which follows.

DESCRIPTION OF THE INVENTION

Figure 1:
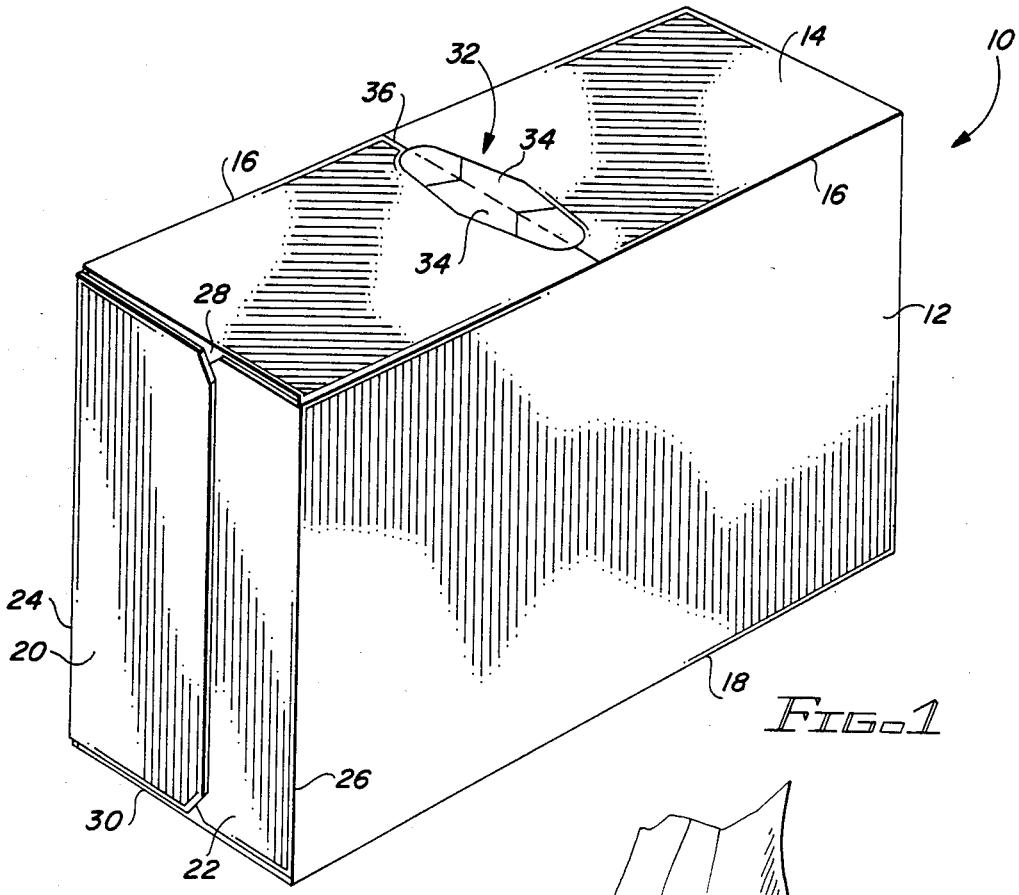
FIG. 1 is a pictorial representation of a preferred embodiment of the sleeve-type carrier of the present invention, shown as it would appear prior to being lifted by its handle.

Referring to FIG. 1, a sleeve-type carrier incorporating the handle of the present invention is shown at 10, and comprises side panels 12 connected to top panel 14 by folds 16. The side panels are also connected by folds 18 to a bottom panel, not visible in this view. The end panel shown is comprised of end flaps 20 and 22 which are connected to the side panels 12 by folds 24 and 26, respectively. The flaps 20 and 22 are adhered by glue to dust flaps 28 and 30 which are foldably connected to the top and bottom panels. The dust flaps are substantially entirely covered by the end flaps 20 and 22 and only small portions of them adjacent their fold lines are visible.

Opening 32 in top panel 14 extends transversely of folds 16 to provide a handle opening for the fingers of a person lifting the carrier. The opening 32 is covered by flaps 34 which are foldably connected to the top panel in a manner described in more detail in connection with FIGS. 2 and 3. Extending from the ends of the opening 32 to the folds 16 are slits 36, the function of which will be described hereinafter.

Figure 2:
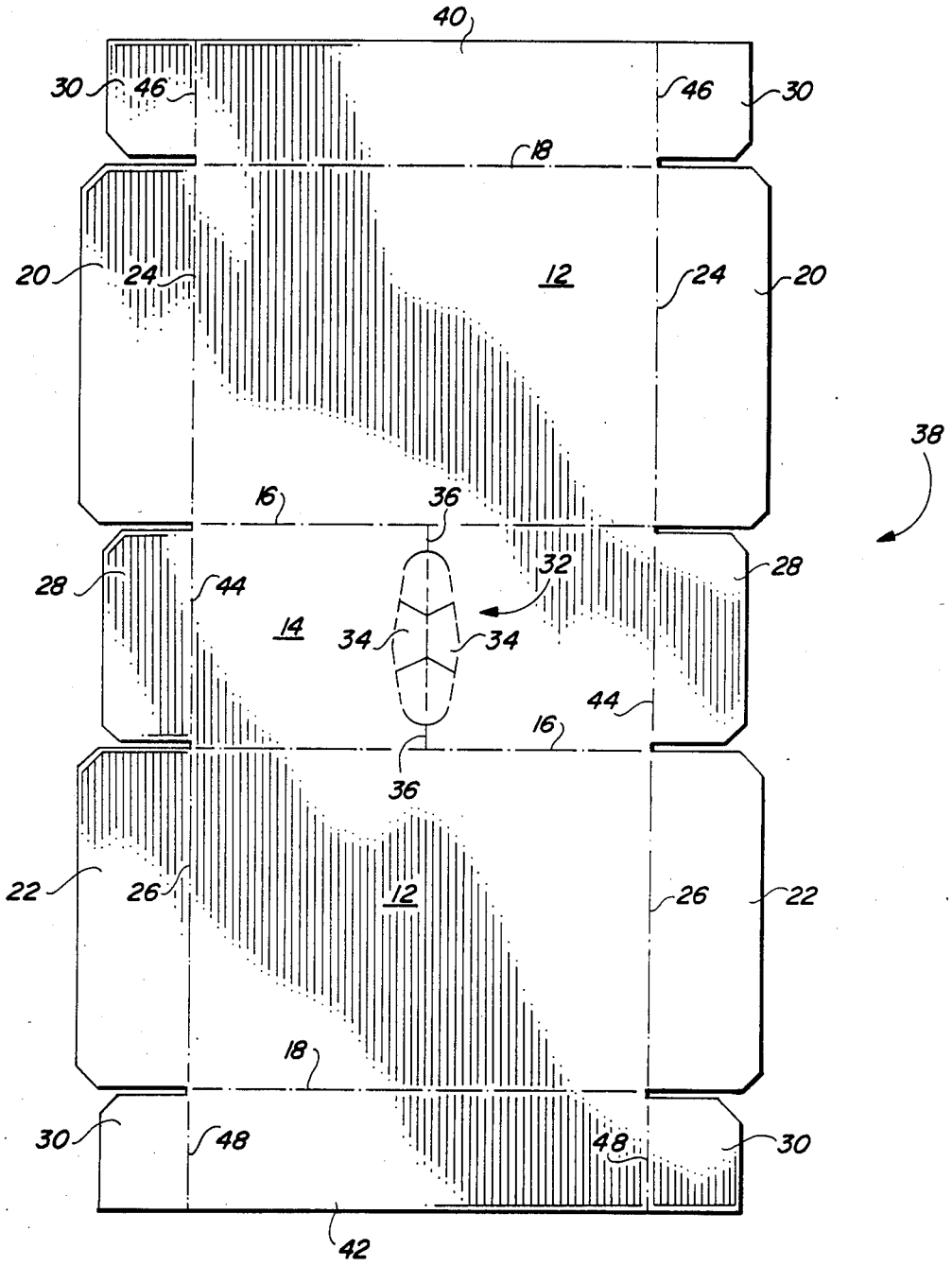
FIG. 2 is a plan view of a production blank for forming the carrier of FIG. 1.

Referring to FIG. 2, a production blank from which the carrier 10 can be formed is indicated at 38. The central section 14 corresponds to the top panel of the carrier of FIG. 1, the intermediate sections 12 correspond to the side panels of the carrier, and the score lines 16 connecting the central section to the intermediate sections correspond to the folds 16 of the carrier 10. Connected to intermediate sections 12 by score lines 18 are end sections 40 and 42 which are dimensioned so that portions of them overlap when the blank is folded along score lines 16 and 18. The overlapping portions of sections 40 and 42 are glued together to form the bottom panel of the carrier 10.

Flaps 20 and 22 are connected to intermediate sections 12 by score lines 24 and 26 to enable them to be folded toward each other to form the end panels of the carrier 10. Flaps 28, connected to central section 14 by score lines 44, are adapted to be folded downwardly prior to the flaps 20 and 22 being folded so that they can act as a support against which the flaps 20 and 22 are glued. Similarly, flaps 30, connected to end sections 40 and 42 by score lines 46 an 48, are adapted to be folded upwardly prior to the flaps 20 and 22 being folded so that they too can act as a support against which the flaps 20 and 22 are glued. This arrangement is well known in the art and provides a strong construction capable of supporting the weight of the full beverage cans in the package.

Figure 3:
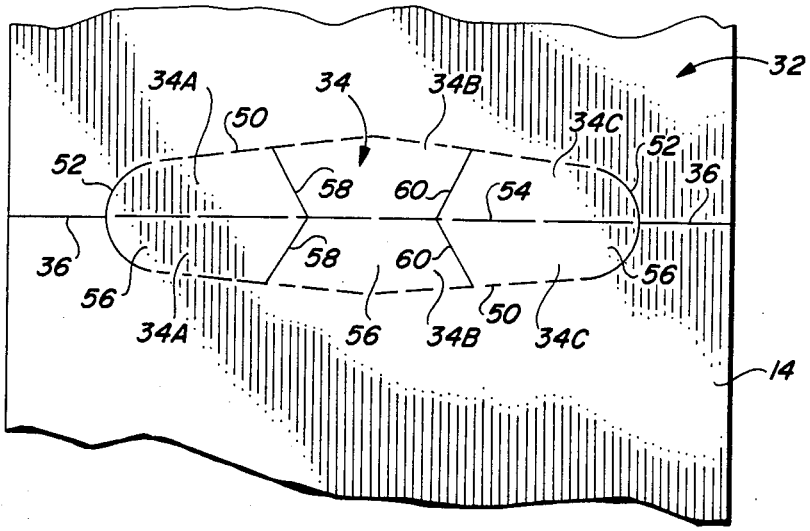
FIG. 3 is an enlarged partial plan view of the handle opening area of the production blank.

Referring to both FIGS. 2 and 3, the handle opening 32 comprises spaced elongated edges 50 connected at their ends to short arcuate edges 52. As best shown in FIG. 3, the elongated edges are spaced apart a relatively great distance at approximately the midpoint of their length and a relatively short distance adjacent the arcuate edges 52. The opening is shown covered by flaps 34 which are foldably connected to the central section 14 of the blank, or in other words to the top panel 14 of the carrier, along the length of the elongated edges 50. The flaps 34 meet in the center of the opening at slit 54 which is aligned with the slits 36. The slit 54 may be produced by a skip-cut operation, which leaves intact narrow widely spaced portions of the top panel indicated at 56. These panels portions retain the flaps in position until they are torn or broken by the flaps being pressed down by the fingers of the user. This arrangement is preferred from a production standpoint because it does not require removal of a cutout portion and from a performance standpoint because it provides a double thickness of paperboard at the handle opening, acting as a reinforcement and as a cushion for the fingers.

Still referring to FIG. 3, each flap 34 is divided into separate tabs 34A, 34B and 34C by slits 58 and 60. This arrangement facilitates the downward folding of the flaps since it requires less force to fold down each individual tab than it would be fold down an entire undivided flap. It also makes it easier for the flap to move past beverage cans which may be packed close to the top panel of the package. Preferably, the narrow sections of paperboard 56 are spaced so that one of them is located in each of the tabs 34A, 34B and 34C. By angling the slits 58 and 60 with respect to the lift 54 the risk of tearing the top panel along the slits 58 and 60 upon lifting is effectively removed. Preferably, the tab slits should not be located at the widest point of the handle opening, as a great deal of stress tends to be localized at this point during lifting of the carrier.

Figure 4:
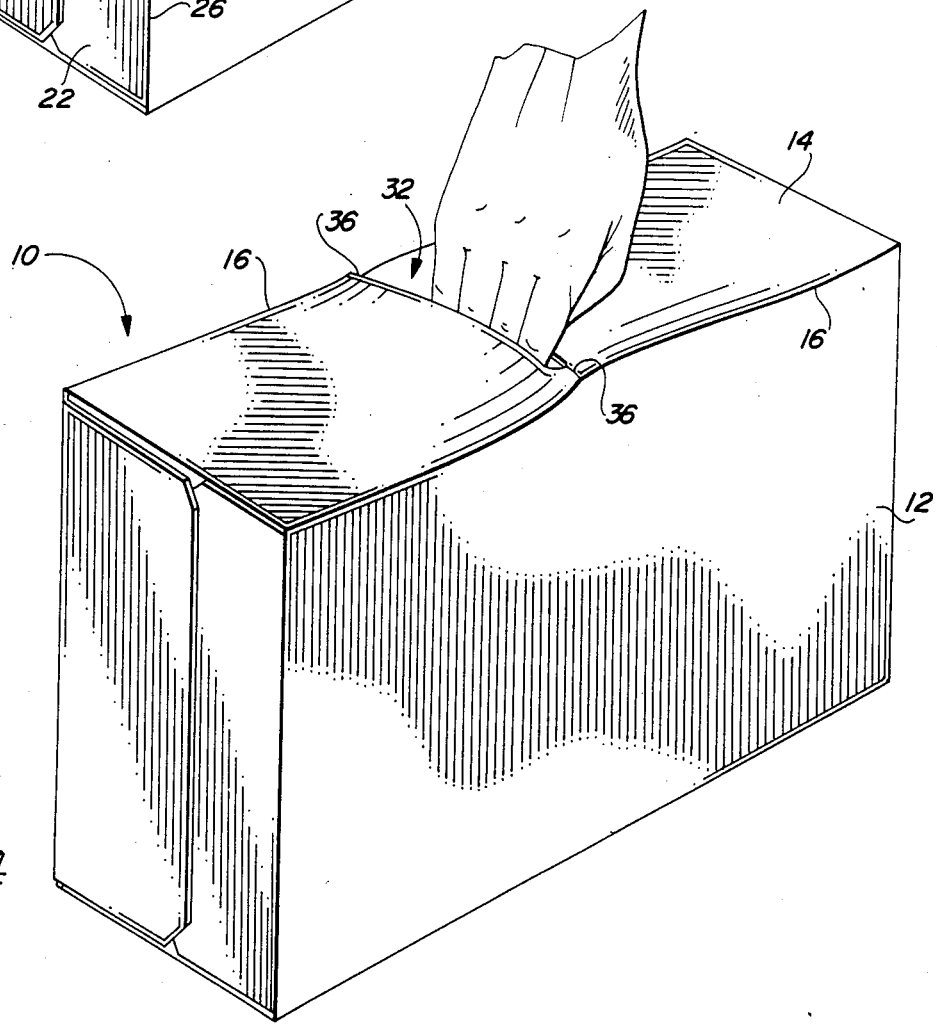
FIG. 4 is a pictorial representation of the carrier of FIG. 1, illustrating the distortions in the carrier caused by the stresses produced by lifting and carrying the carrier.
Figure 5:
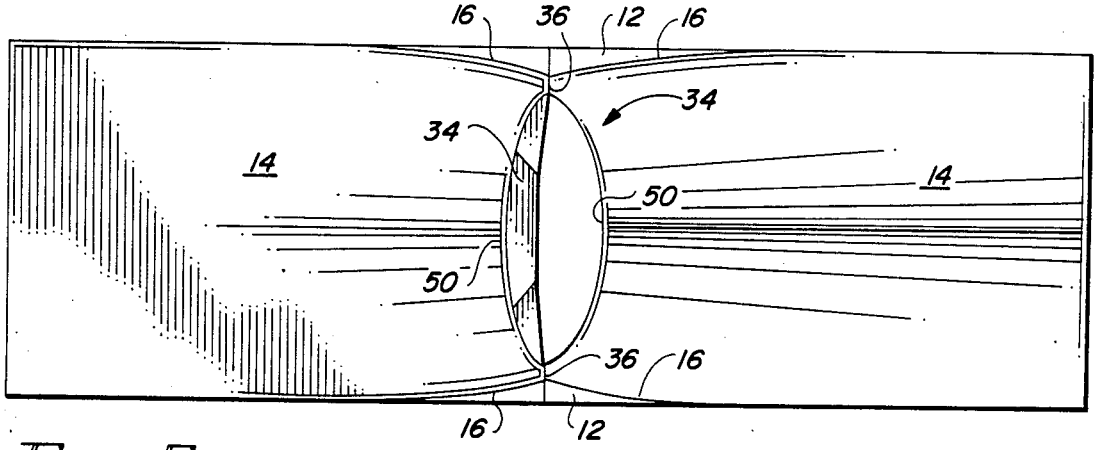
FIG. 5 is a plan view of the carrier of FIG. 3, with the hand of the user omitted for purpose of clarity, showing the lifting distortions from a different angle.
Figure 6:
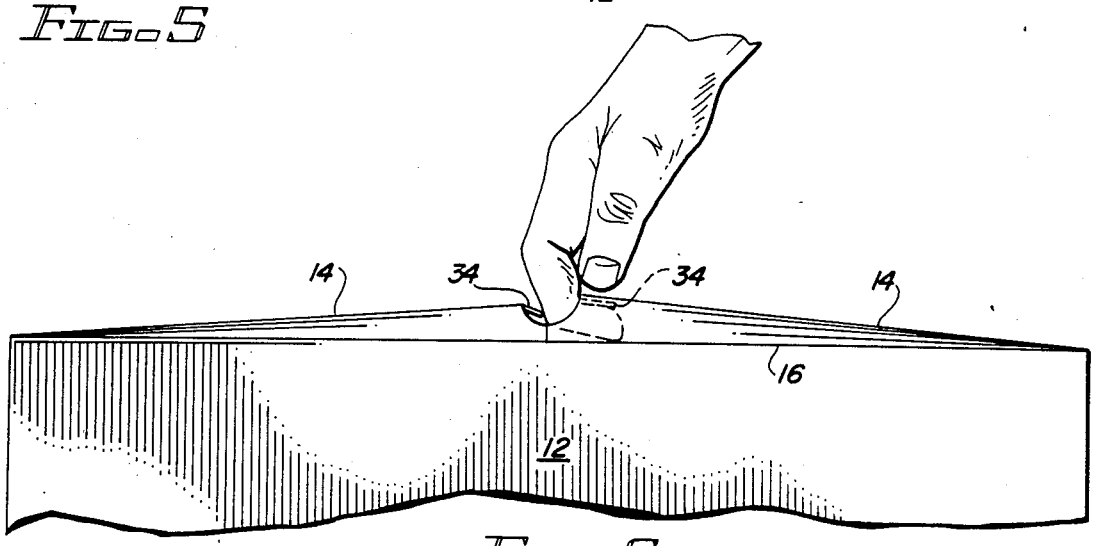
FIG. 6 is a partial side view of FIG. 3, showing the lifting distortions from still another angle.

Referring to FIGS. 4, 5 and 6, in operation a user will press down against one of the flaps 34 and his fingers will fold the flap down about its fold line, which corresponds to one of the elongated edges of the handle opening. The outer portions of the fingers will also contact the other flap 34 and bend it down a distance enabling the fingers to completely fold under the first flap. After the flap has been folded under, or even before the flap has been completely folded into place, the user will lift up the package, introducing stresses into the carrier. As the carrier is lifted the top panel adjacent the fingers is pulled upwardly and the folds 16 are drawn inwardly toward each other in the area of the handle opening. As shown in FIG. 5, the folds associated with the engaged side of the handle opening are drawn toward each other slightly more than the folds associated with the unengaged side of the handle opening, but the difference is only minor and significant stresses exist at both locations. This occurs because the slits 36 transmit stresses to the folds 16, enabling the stresses to be distributed throughout the top and side panels and the folds. As a result the top panel adjacent the unengaged elongated edge of the handle opening is also raised, although just slightly less than the top panel adjacent the engaged elongated edge of the handle opening, resulting in the top panel adjacent both elongated edges of the handle opening being bowed upwardly in a smooth uniform manner, opposing any tendency to tear as would be the case if the stresses were localized.

By making the handle opening wider at the midpoint of the length of the handle the opening can be made quite large so that there is extra room for the fingers of the user. In addition, this configuration is conducive to the uniform tenting or upward bowing of the top panel during lifting. By making the short edges 52 of the handle opening arcuate in shape the tendency to tear at the end of the handle opening is minimized.

It should now be understood that the handle arrangement of the present invention is not only convenient to use, it also distributes the lifting and carrying stresses in an improved uniform manner, reducing or eliminating any tendency to tear. This also permits thinner paperboard to be used, with consequent savings in production costs.

It should be obvious that although a preferred embodiment of the invention has been described, changes to certain details of the preferred embodiment can be made without departing from the spirit and scope of the invention.

What is claimed is:

1. A sleeve-type article carrier, comprising:

a top panel;

a bottom panel;

side panels connected to the top panel and the bottom panel along fold lines;

end panels connecting the top, bottom and side panels;

the top panel containing a handle opening comprising two relatively elongated spaced edges extending transversely of the fold lines connecting the side panels to the top panel and two relatively short edges connecting the elongated edges;

each elongated edge of the handle opening being foldably connected to a flap, the flaps meeting intermediate the elongated edges of the handle opening, each flap being comprised of a plurality of tabs, and each adjacent tab being separated from each other by a slit to facilitate the downward folding of the flaps;

the top panel containing slits extending from the short edges of the handle opening to the fold lines connecting the side panels to the top panel; and the elongated edges of the handle opening being spaced apart at a point midway along their length a distance greater than their spacing adjacent the short edges of the handle opening;

whereby the fingers of a person lifting the carrier can press down against either flap to fold it downwardly about its fold line, and upon lifting the carrier the top panel will bow upwardly adjacent both elongated edges of the handle opening.

2. An article carrier according to claim 1, wherein the relatively short edge of the handle opening are arcuate in shape.

3. An article carrier according to claim 1, wherein each flap is comprised of three tabs, the length of the foldable connection of the middle tab being greater than the length of the middle tab where the flaps meet.

4. An article carrier according to claim 3, wherein the length of the foldable connections of the end tabs is less than the length of the end tabs where the flaps meet.

5. An article carrier according to claim 1, wherein the spacing between the elongated edges of the handle opening at a point midway along their length is the maximum spacing between said elongated edges.

6. An article carrier according to claim 1, wherein the flaps are weakly connected to each other so as to be readily separated when the fingers of a user press down against one of the flaps.

7. An article carrier according to claim 6, wherein the slits extending from the short edges of the handle opening to the fold lines connecting the side panels to the top panel are aligned with the weak connection between the flaps.

8. An article carrier according to claim 7, wherein the short edges of the handle opening are arcuate and each flap is of similar but reverse shape.

9. A production blank adapted to be formed into a sleeve-type article carrier, comprising:

a sheet of generally rectangular shape;

the sheet having a central section intended to become the top panel of the carrier, end sections adapted to be connected together to form the bottom panel of the carrier, intermediate sections connected to the central section and the end sections by score lines and intended to become the side panels of the carrier, and flap sections connected to the intermediate sections by score lines and intended to become the end panels of the carrier;

the central section having a handle opening comprising two relatively elongated spaced edges extending transversely of the score lines connecting the central section to the intermediate sections and two relatively short edges connecting the elongated edges;

each elongated edge of the handle opening being connected to a flap by a fold line, the flaps meeting intermediate the elongated edges of the handle opening, each flap being comprised of a plurality of tabs, each tab being separated from each other by a slit to facilitate the downward folding of the flaps;

the central section containing slits extending from the short edges of the handle opening to the score lines connecting the central section to the intermediate sections; and the elongated edges of the handle opening being spaced apart at a point midway along their length a distance greater than their spacing adjacent the short edges of the handle opening;

whereby the fingers of a person lifting a carrier formed from the blank can press down against either handle opening to fold it downwardly about its fold line, and upon lifting the carrier the top panel will bow upwardly adjacent both elongated edges of the handle opening.

10. A production blank according to claim 9, wherein each flap is comprised of three tabs, the length of the fold line of the middle tab being greater than the length of the middle tab and the length of the fold line of the end tabs being less than the length of the end tabs.

* * * * *